US009339680B2

(12) United States Patent
Sorbel et al.

(10) Patent No.: US 9,339,680 B2
(45) Date of Patent: May 17, 2016

(54) PORTABLE PHYSICAL THERAPY AND EXERCISING DEVICE

(71) Applicants: Shayna Sorbel, Newport Coast, CA (US); Floyd W. Kaylor, Newport Coast, CA (US)

(72) Inventors: Shayna Sorbel, Newport Coast, CA (US); Floyd W. Kaylor, Newport Coast, CA (US)

( * ) Notice: Subject to any disclaimer, the term of this patent is extended or adjusted under 35 U.S.C. 154(b) by 598 days.

(21) Appl. No.: 13/723,057

(22) Filed: Dec. 20, 2012

(65) Prior Publication Data

US 2014/0180179 A1 Jun. 26, 2014

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 22/20*** | (2006.01) |
| ***A63B 23/035*** | (2006.01) |
| ***A63B 23/04*** | (2006.01) |
| ***A63B 23/12*** | (2006.01) |

(52) U.S. Cl.

CPC ..... *A63B 21/0442* (2013.01); *A63B 21/0552* (2013.01); *A63B 21/4015* (2015.10); *A63B 21/4019* (2015.10); *A63B 22/20* (2013.01); *A63B 23/03508* (2013.01); *A63B 23/04* (2013.01); *A63B 23/12* (2013.01); *A63B 21/0557* (2013.01); *A63B 21/4043* (2015.10); *A63B 23/03541* (2013.01); *A63B 23/0494* (2013.01); *A63B 23/1209* (2013.01); *A63B 2209/02* (2013.01); *A63B 2209/10* (2013.01)

(58) Field of Classification Search

CPC ..... A61H 1/00; A61H 1/02; A61H 1/0266; A61H 22/01; A61H 22/0157; A61H 22/1253; A61H 22/1261; A61H 22/1269; A61H 22/164; A61H 22/1642; A63B 21/0442; A63B 21/0552; A63B 21/0557; A63B 22/20; A63B 23/03508; A63B 23/04; A63B 23/0494; A63B 23/12; A63B 2209/02; A63B 2209/10; A63B 21/4019; A63B 21/4015; A63B 23/1209; A63B 23/03541; A63B 21/4043

USPC ..... 601/23, 27, 28

See application file for complete search history.

(56) References Cited

U.S. PATENT DOCUMENTS

| | | | | |
|---|---|---|---|---|
| 3,713,437 | A * | 1/1973 | Wiedmer | 601/27 |
| 4,263,902 | A * | 4/1981 | Dieterich | 602/30 |
| 5,127,892 | A * | 7/1992 | Sawdon | 482/79 |
| 6,063,013 | A * | 5/2000 | Vathappallil | 482/121 |
| 6,283,897 | B1 * | 9/2001 | Patton | 482/79 |
| 6,935,991 | B1 * | 8/2005 | Mangino | 482/51 |
| 7,278,227 | B2 * | 10/2007 | Masoodifar | 36/114 |

* cited by examiner

*Primary Examiner* — Steven Douglas

(74) *Attorney, Agent, or Firm* — CIONCA Law Group P.C.; Marin Cionca

(57) ABSTRACT

A physical therapy and exercising apparatus comprising an upper surface configured to fit a person's foot or hand, and a bottom surface, wherein, when the apparatus is placed on a flat surface, only a portion of the bottom surface touches the flat surface, such that low-friction gliding on the flat surface, of the person's foot or hand and apparatus, together, is facilitated.

6 Claims, 7 Drawing Sheets

PORTABLE PHYSICAL THERAPY AND EXERCISING DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates generally to apparatuses for physical therapy and exercising and particularly to a foot and a hand apparatus.

2. Description of the Related Art

Every joint in the body has a "normal" range-of-motion (ROM). Joints maintain their normal range-of-motion by being moved. It is therefore very important that a person, especially surgical patients, elderly, people with disability, and the like, to move all of her joints every day. Stiff joints can cause pain and can make it hard for the person to do her normal daily activities. Currently, with a prescription, a doctor can either send a person to an outpatient clinic to see a physical therapist or have one come to her home to help her design a personalized exercise program. People with arthritis often follow a therapeutic exercise program and also take part in active leisure or recreational exercise. Therapeutic exercise is exercise recommended by a doctor, a physical therapist or an occupational therapist. It includes specific exercises designed to meet individual needs and achieve specific goals.

It is well known that, due to inactivity, blood clots may develop, which may cause serious medical issues and even death. Furthermore, because of a patient's lack of movement due to post-surgical procedures or someone's sedentary lifestyle, there is a need to safely bring movement to the leg or hand area to avoid potential blood clots.

It is also known that home care costs are increasing in large measure because there is no effective therapeutic device the patient can use on their own to increase or maintain their range-of-motion. Typically, when a person has mobility issues with the knee(s), ankle(s), shoulder(s), and/or elbow (s), they have to go to a physical therapist for the proper equipment to help in their rehabilitation. That is very costly for insurance companies, the government and/or the person.

It is known as well that because of the trauma post-surgical knee patients undergo during surgery, they need a gentle approach to after care in a way as not to aggravate their new knee.

In addition, for many years, it was thought that people with arthritis should not exercise because it would damage their joints. Now, doctors know that when the arthritis is under control, people with arthritis can improve their health and fitness through exercise, without hurting their joints.

Thus, if a person has arthritis, she has more reasons to exercise: to keep her joints from becoming too stiff; to keep the muscles around her joints strong; to keep bone and cartilage tissue strong and healthy; to improve her overall fitness.

There appear to be a limited number of portable medical/therapeutic devices available on the market to be used for physical therapy purposes, i.e., to assist in gaining strength, mobility, and range-of-motion from a surgically repaired knee, ankle, shoulder, and/or elbow, joint replacement, normal wear and tear, general injury, and the like.

Furthermore, the available devices seem to fail to provide a simple, convenient, safe and economical way to help people with limited mobility issues strengthen and increase range-of motion in their knee(s), ankle(s), shoulder(s), elbow(s) and/or the like.

Thus, there is a need for a new and improved physical therapy and exercising apparatus that solves the problems described above.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The portable physical therapy and exercising apparatus was created to assist the physical therapist and patient in active and passive therapy for gaining or maintaining range-of-motion (ROM), increase muscle strength, and increase blood flow. The apparatus can aid the physical therapist, the at-home health care personnel, and/or the person undergoing care (under a doctor/therapist directive) to increase their range-of-motion, mobility, and strength. As it will be described in detail later, the apparatus conforms and attaches to the foot (in one embodiment) or the hand (in another embodiment) of a person and facilitates controlled, low friction sliding on flat surfaces.

With the assistance of a resistant band as an attachment, this is an easy-to-use device that operates to strengthen a knee, ankle, shoulder, and/or elbow when muscles have been weakened. Some common injured sites are: after one has had knee surgery to repair a ligament, meniscus, and/or total knee replacement, the muscles are weakened and/or atrophied; a frequent site of pain in the elderly from years of wear and tear; and with athletes from the tremendous forces their joints endure, to name a few.

The apparatus provides a simple way to bring movement to the leg or hand area without stress, thereby helping avoid potential blood clots due to sedentary activity or from post-surgical inactivity. It helps alleviate home care costs because the patient is able to conduct their own therapy (under a physical therapist or doctor directive) almost anywhere.

The apparatus is also a non-invasive, gentle approach to therapy from trauma caused by injury, prior surgery, wear & tear, and/or natural signs of aging that cause range-of-motion issues having to do with the knees(s), ankle(s), shoulder(s), and/or elbow(s).

The apparatus is a portable device solving issues of not being able to go to a physical therapist, as it can be used at home and/or in office settings as an exercise device increasing muscle movement and mobility. Because it is portable and can be used at home, there is less of an issue of having to pay (via governmental aid/independent insurance companies/or personally) the cost of home health care.

The apparatus services all people, including but not limited to: (1) pre-surgical patients, (2) post-surgical patients, (3)

non-surgical general population, (4) senior citizens, (5) the handicapped, (6) athletes, and (7) adults and children.

The apparatus assists anyone who has had surgically repaired and/or injured knees, ankles, shoulders, and/or elbows, with increased range-of-motion.

By promoting increase in blood flow, the apparatus helps prevent blood clots and the serious medical problems, or even death, they may cause.

The apparatus can aid in the prevention of further muscle atrophy. It is a non-evasive type of exercise to help people who have had surgically repaired and/or injured knees, ankles, shoulders, and/or elbows with increased range-of-motion.

The apparatus provides an inexpensive way (as compared with machines typically used for rehabilitation and/or seeing a physical therapist) for physical therapy to bring back proper range-of-motion in knees, ankles, shoulders and/or elbows. It is an alternative to the common physical therapy methods, which is simple to use.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which.

DETAILED DESCRIPTION OF THE PREFERRED EMBODIMENTS

Figure 1:
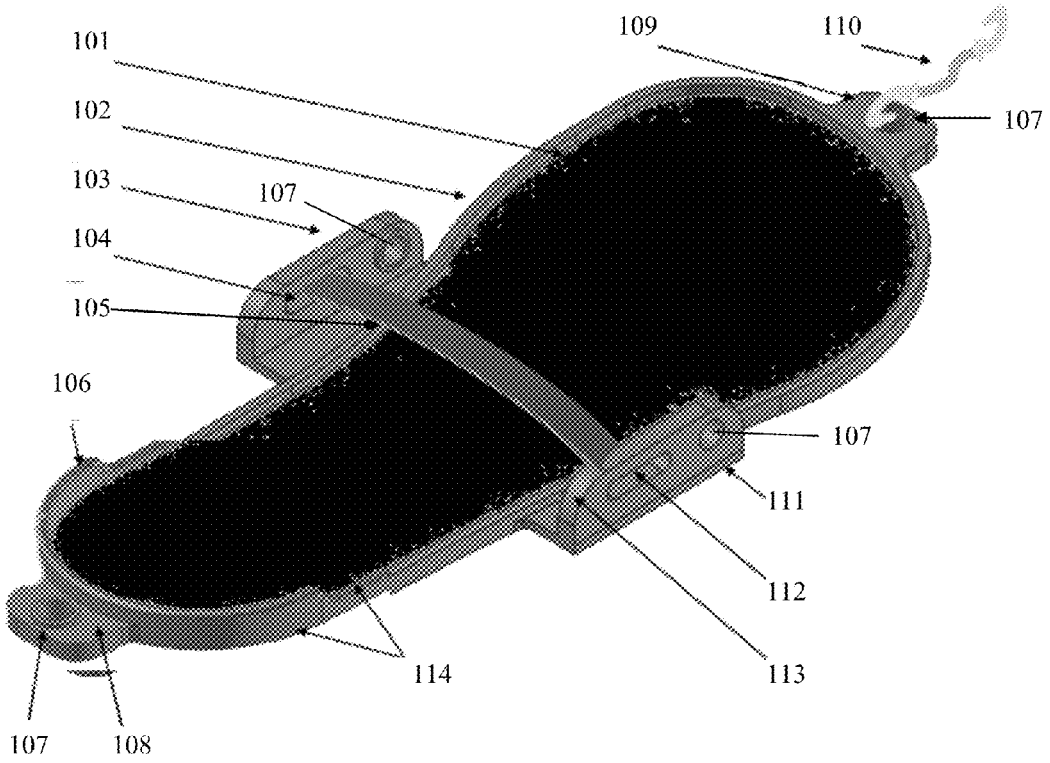
FIG. 1 illustrates a top-perspective view of a foot physical therapy apparatus, according to an embodiment.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

Referring now to FIG. 1, the top-perspective view of a foot physical therapy apparatus, according to one embodiment, is shown. It should be apparent that the foot physical therapy apparatus ("foot apparatus") depicted in FIG. 1 is configured to fit and to be attached to someone's foot when the foot is in need of physical therapy and/or exercising (and then be removed), as it will be explained in more detail below.

The foot apparatus may be made of materials such as plastic (e.g., polyurethane, HDPE, Somos®, carbon fiber, etc.) or other suitable flexible materials. The foot apparatus has several unique features that allow easy front and back, side-to-side movement of the foot. First, as shown in FIG. 1*c*, there is a custom rounded bevel at the bottom of both the tip (115) and heel (117) of the foot apparatus. As shown in FIG. 1*b*, there may be a first convex contact portion and a second convex contact portion on the bottom surface of the foot apparatus. The first and second convex contact portions may be substantially aligned such that, when placed on a flat surface, the foot apparatus and the user's foot are substantially level with the flat surface. The first and second convex contact portions may be rounded bevels, as shown in FIG. 1*c*. Preferably as shown in FIG. 1*c*, each bevel (115 and 117) may substantially follow the contours of the tip and the heel. For example, the rounded bevels may have a U-shaped curve at the heel, covering substantially most of the heel of the apparatus, and may have a horseshoe-shaped curve at the tip, covering substantially most of the forefoot of the apparatus. Second, for support of flat feet and fallen arches, a strategically shaped arch (116, FIG. 1*c*) is carved in the center of the bottom surface of the foot apparatus. It should be apparent that, due to the bevels 115 and 117 and the arch 116, only a portion of the bottom surface of the foot apparatus will become in contact with a flat surface when the foot apparatus is placed on such surface. As shown in FIG. 1*b* and FIG. 1*c*, the bottom surface may have a convex tip bevel and a convex heel bevel, and a concave arch. The convex contact portions or bevels may contact a flat surface when the foot apparatus is placed on the flat surface while the concave arch does not. Thus, a non-stick and/or low-friction contact is created, which allows the person (e.g., a patient in need of physical therapy) using the foot apparatus to glide or move front to back or side-to-side with low or minimum friction. Such gliding may be done on flat surfaces such as the floor of a room.

The foot apparatus may be equipped with four holes or openings 107: one in the front tab 109, one in the back tab 108, one in the left flap 103 and one in the right flap 111. These holes may be used as necessary to add resistant bands 110, such as Thera-Band® bands, bungee cord and so on, to the foot apparatus. As shown in FIG. 1, such resistant bands 110 may be fitted with hooks at each end, for easy and quick fastening into the holes 107 at one end, and to a suitable structure or object, such as a fixed or quasi-fixed object (e.g., heavy furniture), at the other end. Gliding with one or more resistant bands 110 attached, will require more effort/force, and thus, additional and/or specific therapeutic benefits may be obtained such as building muscle and/or increasing blood flow. As shown in FIG. 1, the holes 107 may be reinforced for additional strength such as by using additional material to make them, for example, taller than the front and back tabs 109 and 108. The additional material may be the same as the one used to make the foot apparatus, or a different one, such as carbon fiber.

As an added safety feature, the side flaps 103 and 111 may each have a slot 104 and 112, which may be used to secure the foot onto the foot apparatus, by using a safety strap 105 made out of, for example, Velcro®. Furthermore, the top surface of the foot apparatus may be surrounded by a (beaded) rounded edging 102 for holding in a removable pad 101 of neoprene/ foam or equivalent material, for providing additional support and cushion to the foot. This is important as, typically, people with foot injuries will have sores or bruises. Also, for added safety and for keeping the foot in place when gliding backwards or sideways, a rounded heel stop 106 may be provided, preferably, as an integral part of the foot apparatus. It should also be noted that the foot apparatus may have rounded edges 113 (right and left side flaps) and 114 (top and bottom perimeter) for additional safety (e.g., to prevent cuts), increased performance (rounded edge of bottom perimeter may facilitate easy, low-friction gliding), and/or, very importantly, for ornamental purposes (i.e., the round edges, together with the other ornamental features of the foot apparatus, contribute to its overall esthetic and pleasant appearance).

Figure 1A:
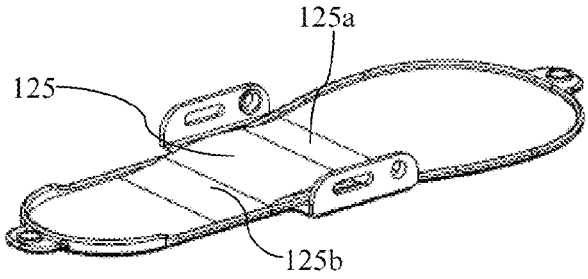
FIG. 1*a* illustrates another (different angle) top-perspective view of the foot physical therapy apparatus from FIG. 1 (without the pad 101).
Figure 1B:
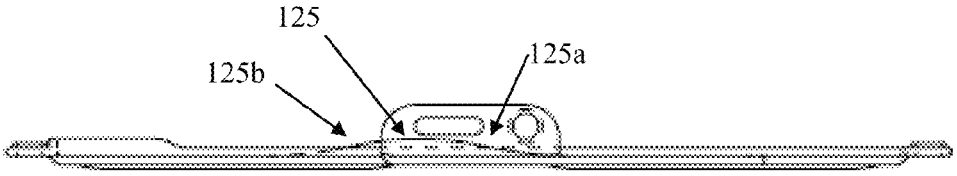
FIG. 1*b* is a side view of the foot physical therapy apparatus from FIG. 1.
Figure 1C:
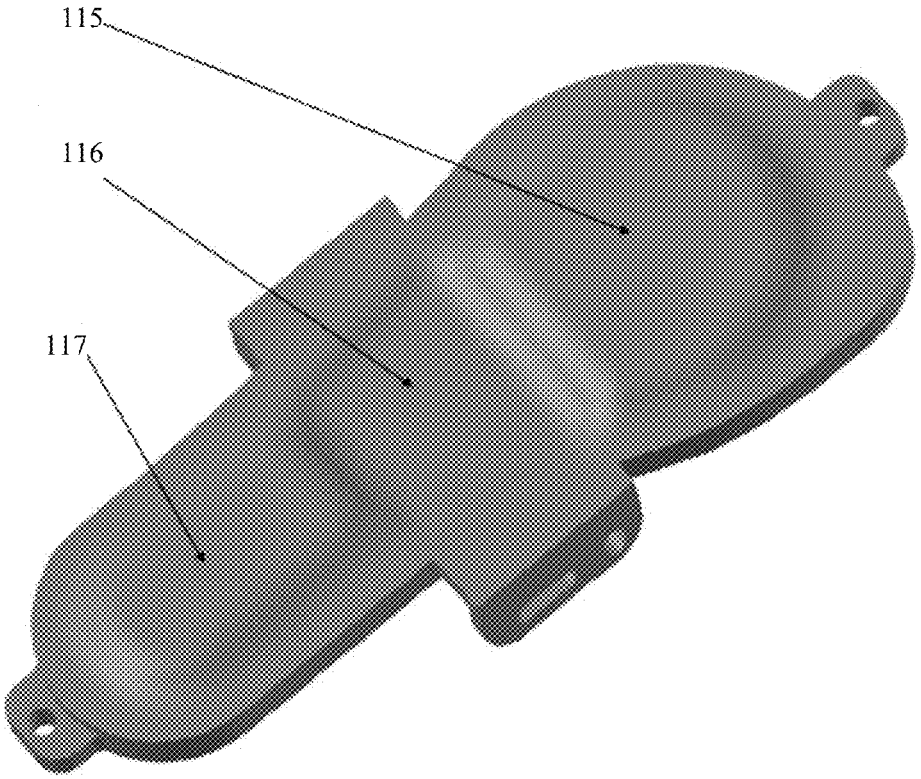
FIG. 1*c* illustrates a bottom-perspective view of the foot physical therapy apparatus from FIG. 1.

As shown in FIGS. 1*a-b*, the upper surface of the foot apparatus, upon which the foot sits, may be configured to be other than flat, in order to better conform to the foot, such as by having a raised portion 125 and two transitional portions 125*a* (front) and 125*b* (back).

Figure 2:
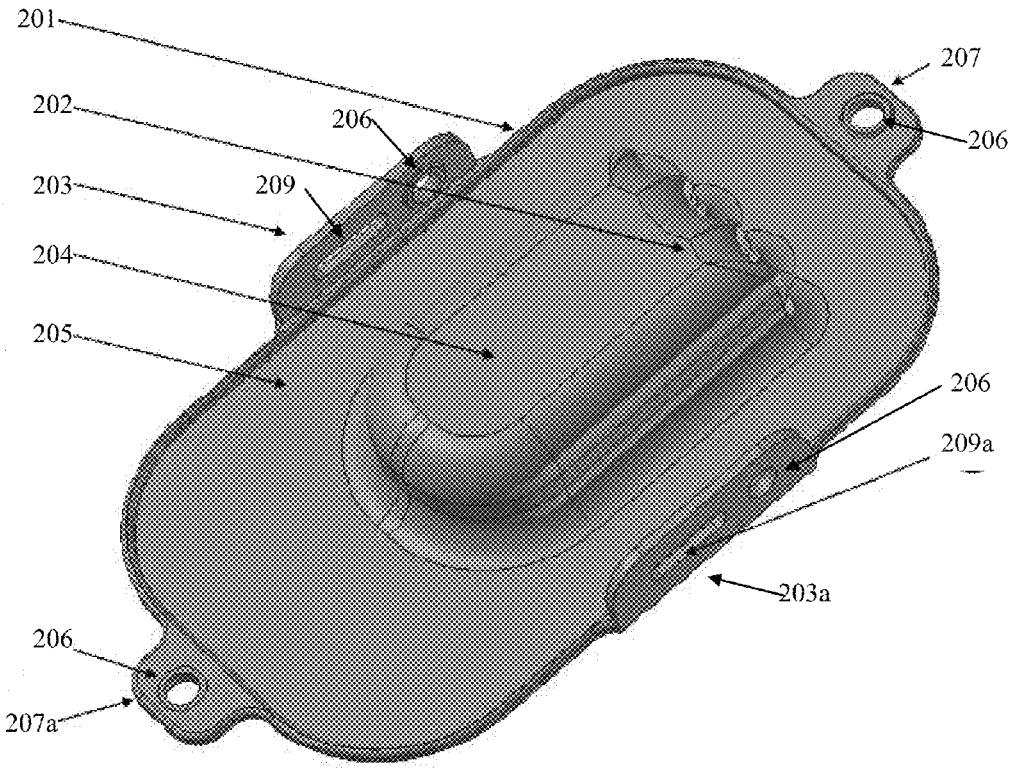
FIG. 2 illustrates a top-perspective view of a hand physical therapy apparatus, according to another embodiment.
Figure 2A:
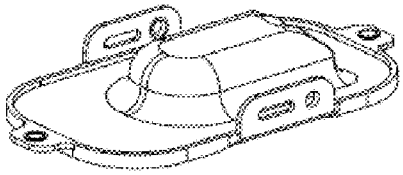
FIG. 2*a* illustrates another (different angle) top-perspective view of the hand physical therapy apparatus from FIG. 2.
Figure 2B:
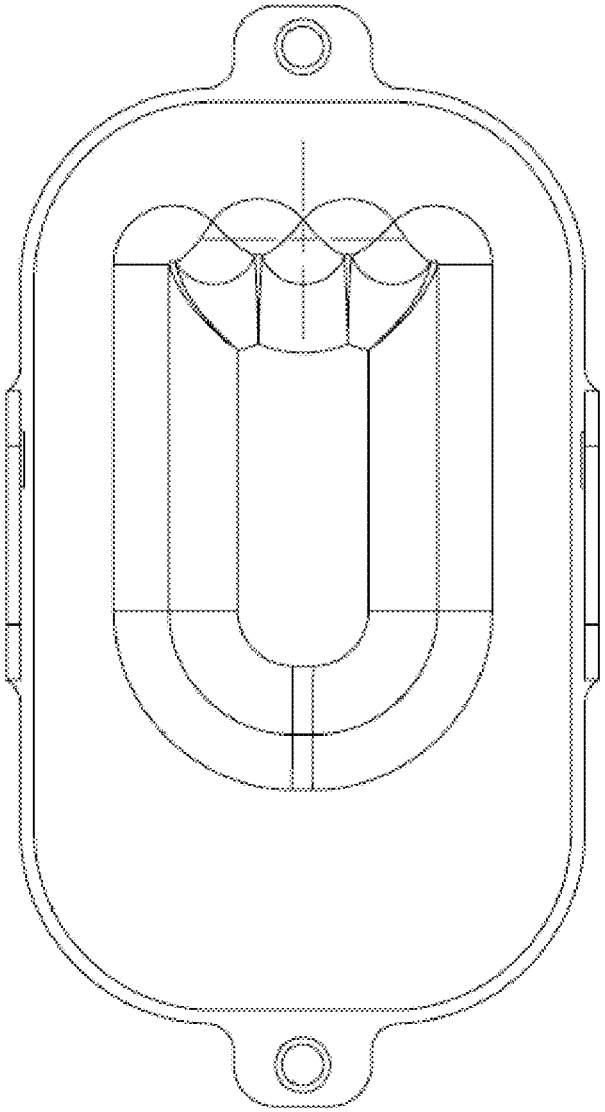
FIG. 2*b* is a top view of the hand physical therapy apparatus from FIG. 2.

Referring now to FIG. 2, a top-perspective view of a hand physical therapy apparatus, according to another embodiment, is shown. It should be apparent that the hand physical therapy apparatus ("hand apparatus") depicted in FIG. 2 is configured to fit and to be removably attached to and work with someone's hand for such purpose as physical therapy and/or exercising.

Figure 2C:
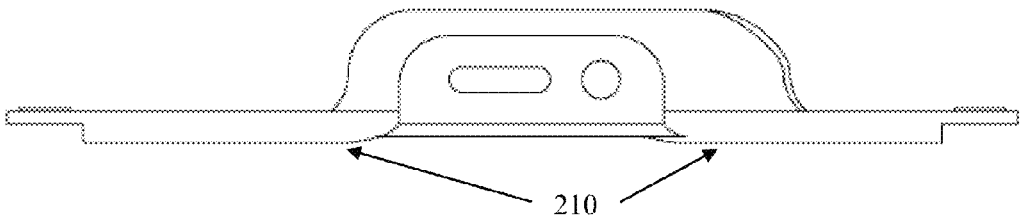
FIG. 2*c* is aside view of the hand physical therapy apparatus from FIG. 2.
Figure 2D:
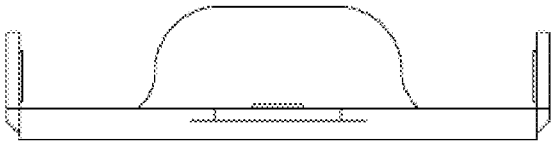
FIG. 2*d* is a back view of the hand physical therapy apparatus from FIG. 2.
Figure 2E:
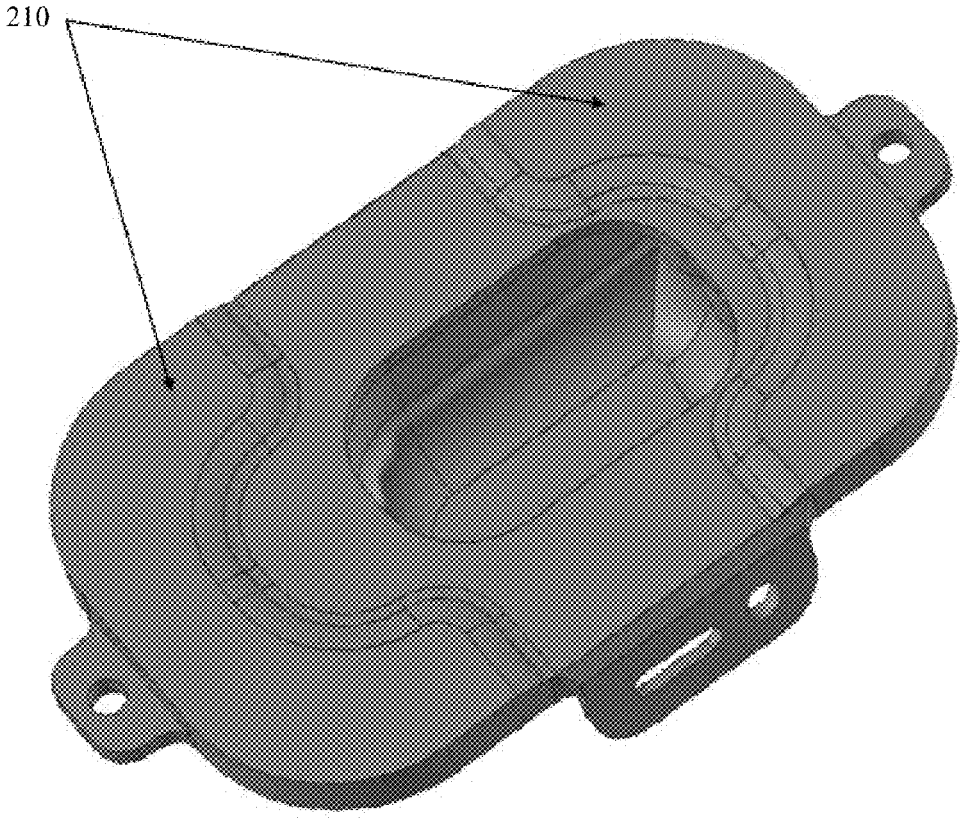
FIG. 2*e* illustrates a bottom-perspective view of the hand physical therapy apparatus from FIG. 2.

The hand apparatus may also be made of materials such as plastic (e.g., polyurethane, HDPE, Somos®, carbon fiber, etc). The hand apparatus has several unique features that allow easy front and back and side-to-side gliding movements of someone's hand when using the hand apparatus. First, as shown in FIGS. 2*c* and 2*e*, there is a gliding/sliding pad 210 at the bottom of both the front and the back of the hand apparatus. It should be apparent that the area of the sliding pad 210 is smaller than the total area of the bottom surface of the hand apparatus (see FIG. 2*e*). The remaining of the bottom surface of the hand apparatus is raised (see FIG. 2*c*) such that it does not come in contact with the contact surface on which the hand apparatus glides. Only the sliding pad 210 will come in contact with the contact surface. The purpose of this configuration is to reduce friction when sliding over a contact surface such as a tabletop, a floor or wall surface. It should be understood that the shape, size and/or location of the sliding pad 210 could be modified as needed (e.g., to correlate with the amount of friction desired), without departing from the scope and essence of the invention.

Furthermore, the hand apparatus is equipped with four holes/openings 206 (see FIG. 2) as follows: one in the front tab 207, one in the back tab 207*a*, one in the left support rail 203 and one in the right support rail 203*a*. These holes may be used as necessary to add bands (not shown), such as Thera-Band® bands, bungee cord and so on, to the hand apparatus. Again, as described above when referring to the foot apparatus, such resistant bands may be fitted with hooks at each end, for easy and quick fastening into the openings 206 at one end and to a fixed or quasi-fixed structure (e.g., heavy furniture) at the other end. Gliding with one or more resistant bands attached, will require more force, and thus, additional and/or specific therapeutic benefits may be obtained such as building muscle and/or increasing blood flow. Also as described earlier, the openings 206 may be reinforced for additional strength to prevent breakage, such as by using additional material to make them taller/wider than the tab or the support rail in which they are located. The additional material may be the same as the one used to make the hand apparatus, or a different one, such as carbon fiber.

As an added safety feature, the side support rails 203 and 203*a* may each have a slot 209 and 209*a*, which may be used to secure the hand onto the hand apparatus, by using a safety strap (not shown) made out of, for example, Velcro®. Furthermore, the top surface of the hand apparatus may be surrounded by a reinforced border 201 for holding in a removable support pad (not shown) in location 205. The support pad may be made of neoprene/foam or equivalent material to provide additional support and cushion to the hand. This is important as, typically, people with hand injuries will have sores or bruises.

As shown in FIG. 2, a center hand rest 204 and a fingers rest 202 is also provided to be used by the person using the hand apparatus to rest her hand and, if any strength is present in the hand and/or fingers, hold on to the apparatus. Whether or not strength in the hand and/or fingers is present, the safety strap described earlier may be used for additional safety.

It should also be noted that the hand apparatus may also have rounded edges for additional safety (e.g., to prevent cuts), increased performance (rounded edge of bottom perimeter may facilitate easy, low-friction gliding), and/or, very importantly, for ornamental purposes (i.e., the round edges, together with the other ornamental features of the hand apparatus, contribute to its overall esthetic and pleasant appearance).

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A physical therapy and exercising apparatus comprising a tip, a heel, a left side, a right side, and an upper surface adapted to receive, to fit and to at least partially secure a person's foot to the apparatus, and a low-friction contact bottom surface having a first convex contact portion at the tip, a second convex contact portion at the heel of the apparatus and a concave arch between the first and the second convex contact portions, wherein the first and the second convex contact portions have substantially the same thickness, wherein, when the bottom surface of the apparatus is placed on a flat surface, only the first and the second convex contact portions of the bottom surface touch the flat surface, such that low-friction gliding, of the person's foot and apparatus, together, on the flat surface, is permitted, and wherein, the upper surface is substantially parallel with the flat surface when the first and the second convex contact portions of the apparatus are placed on the flat surface.

2. The apparatus of claim 1, further comprising a plurality of openings, each being capable of receiving a hook, wherein a resistant cord having a first end and a second end is associated with the hook on the first end, such that when the second end of the resistant cord is attached to a structure, the person wearing the apparatus needs to make additional effort, substantially proportional with the resistance of the cord, in order to glide her foot, together with the apparatus, on the flat surface, wherein the plurality of openings comprises a longitudinal pair of openings for front and back gliding, the longitudinal pair having a first opening at the tip and a second opening at the heel of the apparatus, and a transversal pair of openings for lateral gliding, the transversal pair of openings being substantially aligned with a geometrical center of the apparatus and having a third opening on the left side and a fourth opening on the right side of the apparatus.

3. The apparatus of claim 2, wherein the at least partially securing of the person's foot is accomplished by a heel stop, and wherein the apparatus further comprises an edge surrounding the apparatus and extending upwards from the upper surface and a removable pad held within the edge and onto the upper surface.

4. The apparatus of claim 3, further comprising two side flaps, one on a left side and one on a right side, each having a slot to be used to further secure the foot onto the apparatus by using a safety strap.

5. The apparatus of claim 4, wherein the first and second convex contact portions of the bottom surface that touches the flat surface are a first bevel at the tip and a second bevel at the heel of the apparatus and the concave arch is disposed between the first and the second bevels, wherein the first and second bevels have substantially the same thickness.

6. A physical therapy and exercising apparatus comprising an upper surface configured to receive, to fit and to at least partially secure a person's foot to the apparatus by a heel stop and a safety strap, the safety strap being configured to attach to a first slot on a left side flap and a second slot on a right side flap, and a bottom surface having a tip bevel, a heel bevel, and a center arch between the tip and heel bevels; wherein, when the apparatus is placed on a flat surface, only the tip bevel and the heel bevel of the bottom surface touch the flat surface, such that low-friction gliding, of the person's foot and apparatus, together, on the flat surface, is permitted; the apparatus further comprising a plurality of openings, each being capable of receiving a hook, wherein a resistant cord having a first end and a second end is associated with the hook on the first end, such that when the second end of the resistant cord is attached to a structure, the person wearing the apparatus needs to make additional effort, substantially proportional with the resistance of the cord, in order to glide her foot, together with the apparatus, on the flat surface wherein, the upper surface is substantially parallel with the flat surface when the tip bevel and the heel bevel of the apparatus are placed on the flat surface.

* * * * *